United States Patent [19]

Hodges

[11] 4,383,491

[45] May 17, 1983

[54] METHOD AND APPARATUS FOR HOSIERY MANUFACTURE

[75] Inventor: Michael J. Hodges, High Wycombe, England

[73] Assignee: Detexomat Machinery Limited, High Wycombe, England

[21] Appl. No.: 221,840

[22] Filed: Dec. 31, 1980

[30] Foreign Application Priority Data

Jan. 7, 1980 [GB] United Kingdom ..... 8000402

[51] Int. Cl.[3] ..... D05B 23/00; D05B 97/00

[52] U.S. Cl. ..... 112/262.2; 112/121.15

[58] Field of Search ..... 112/121.15, 121.12, 112/2, 262.2, 262.1, 303; 223/43

[56] References Cited

U.S. PATENT DOCUMENTS

| | | | |
|---|---|---|---|
| 3,429,284 | 2/1969 | Bryan | 112/121.15 |
| 3,452,691 | 7/1969 | Ditrich | 112/121.15 |
| 3,532,258 | 10/1970 | Kienel | 223/43 |
| 3,669,048 | 6/1972 | Dunn et al. | 112/121.15 X |
| 3,941,069 | 2/1976 | Fukuyama | 112/262.2 |
| 3,970,015 | 7/1976 | Fukuyama | 112/121.12 |
| 4,133,276 | 1/1979 | Selvi | 112/121.15 |
| 4,133,280 | 1/1979 | Takatori et al. | 112/262.2 |
| 4,192,242 | 3/1980 | Haselgrove et al. | 112/262.2 |

FOREIGN PATENT DOCUMENTS

| | | | |
|---|---|---|---|
| 1039104 | 8/1966 | United Kingdom | 112/121.15 |

*Primary Examiner*—H. Hampton Hunter

*Attorney, Agent, or Firm*—Wellington M. Manning, Jr.; Luke J. Wilburn, Jr.

[57] ABSTRACT

For toe seaming hosiery knitted with reinforced and/or shaped heels, automatic toe closer has one or more hose carriers, a sewing machine and a clamping means movable for conveying a toe end portion of a hose on a carrier past the sewing machine for toe closing. The toe closer has a heel positioner comprising a rotationally-driven roller mounted for movement into and out of frictional engagement with a hose on the carrier, rotation of the roller in contact with the hose causing a rotation of the latter about the carrier until a mark on the hose aligns with a photosensor responsible, when alignment occurs, for causing disengagement of the roller from the hose leaving the latter in a properly adjusted attitude on the carrier in readiness for seaming.

12 Claims, 9 Drawing Figures

METHOD AND APPARATUS FOR HOSIERY MANUFACTURE

The present invention relates to an improved method and apparatus for use in manufacturing hosiery, i.e. socks, stockings, pantyhose and boot liners, and more especially for use in manufacturing high quality socks and stockings.

It is common practice to knit hose in a tubular, open-ended form and then to close one end, namely the toe, by seaming. Better quality hose are so knitted as to produce a shaped or reinforced heel portion. The toe seam should then bear some definite orientation relationship to the heel, depending on the hose design and the particular form which the toe seam takes.

Figure 1A:
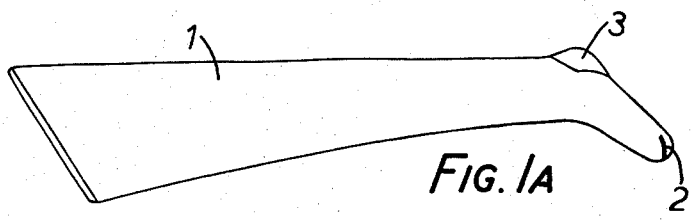
Figure 1B:
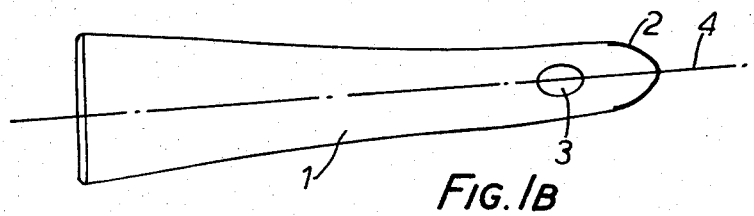

FIGS. 1A and 1B of the accompanying drawings show a hose 1 from the side and from beneath, respectively, in each case laid out flat. The toe seam 2 has a particular orientation relationship to the heel portion 3, such that when this hose is worn with the wearer's heel embraced by the heel portion 3, the toe seam 2 lies approximately across the ends of the toes. In this exemplary hose, a "fishmouth" seam is used. This is symmetrical about the longitudinal centre line 4 of the hose and so is the heel portion 3. In "Getaz" and underfoot seams, the seam may lie in a plane perpendicular to the plane of FIG. 1B, this plane desirably containing the centre line 4. Such seams should therefore be aligned with centre line 4. Irrespective of the seam shape, there should always be a definite, specific relationship between seam and heel portion.

To attain the desired relationship, hose must always be inserted into a seamer with the heel portion in a predetermined attitude. This could be done manually quite successfully, provided there is time available for the operator to make such adjustments as necessary. The desire for ever higher production rates has led to the development of automatic machinery capable of seaming 420 to 600 dozen pairs of hose per 8 hour shift. Such a machine is the Detexomat "Speedomatic HS". At production speeds of this level there is too little time for an operator to feed the hose to the machine and then to adjust the hose properly. Thus, it is well nigh impossible for anyone to produce toe seamed hose consistently having the desired toe and heel relationship.

The object of the present invention is to provide an automatic method and apparatus for seaming the toes of hose, wherein the heel is adjusted to a predetermined orientation before seaming is commenced, and this orientation is retained until the toe closing operation has commenced.

According to one aspect of this invention, there is provided a method of automatically closing the toes of hosiery, wherein a tubular hose blank having a shaped and/or reinforced heel is mounted on a carrier, a toe end portion of the blank mounted on the carrier is caused to adopt a laterally spread flat condition and in this condition is moved past a seamer which generates a toe seam of a predetermined outline across the toe end portion, and wherein a driven member is brought into engagement with the toe end portion after mounting on the carrier and said toe end portion is rotated thereby around the carrier until the said toe end portion and the heel are in a predetermined attitude upon the carrier, the resulting mutual orientation of the toe end portion and heel being preserved in the course of spreading the toe end portion flat and seaming.

The invention also provides a machine for automatically closing the toes of hosiery supplied in open-ended tubular form having shaped and/or reinforced heels, the machine comprising a seamer, means for moving a flattened hose toe end past the seamer to generate a toe closing seam of predetermined outline therein, a carrier to support the hose on the machine, means movable into and out of engagement with the toe end portion of a hose on the carrier, prior to movement of the toe end past the seamer, and operative to rotate the toe end portion around the carrier and with it the heel, and control means including a sensor located at a set, datum position with respect to the carrier, the control means being operable to effect a discontinuation of rotation of the toe end portion when the latter has been rotated to bring an identifiable feature therein into alignment with the sensor.

The invention further provides a machine for automatically closing the toes of hosiery supplied in open-ended tubular form having shaped and/or reinforced heels, the machine comprising a seamer, movable clamp means for gripping a flattened hose toe end and for moving it past the seamer to generate a toe closing seam therein, a carrier to support the hose on the machine and means operable to advance a toe end portion of the hose from the carrier into the clamp means, the machine further including a rotationally-driven member mounted for movement into and out of engagement with the toe end portion supported on the carrier, prior to advance thereof into the clamp means, for rotating the toe end portion when engaged thereby around the carrier and with it the heel, and rotation control means including a sensor located at a set, datum position with respect to the carrier, the said control means being operable to effect a discontinuation of rotation of the toe end portion when the latter has been rotated to bring an identifiable feature therein into alignment with the sensor.

The identifiable feature is provided in the hose, by the hosiery manufacturer, in a predetermined position relative to the heel. When the sensor responds upon alignment of the said feature therewith, it may produce a signal which, for instance, is responsible for disengaging the rotationally-driven member from the toe end portion so that the latter ceases rotating around the carrier. The signal could be arranged to arrest driving of the rotationally-driven member instead. Owing to the said feature being fixed relative to the heel and the sensor being in a set datum position, the heel will be in a prescribed attitude on the carrier when the rotationally-driven member is either disengaged from the hose toe end portion (as preferred), or its drive is arrested. The said feature can take a variety of forms. For instance, it may be a knitted band contrasting in colour from the remainder of the hose knit, or a band of dropped or transferred stitches.

The carrier can be a tubular member useful for everting hose, as is known. The toe-advancing means can be a pair of fingers or blades which advantageously move apart inside the hose toe end portion to spread the latter flat for entry into the clamp means. The fingers are arranged also to execute a movement towards, into and then away from the clamp means for depositing the toe end in the clamp means. Friction between the toe end portion and the fingers preserves the orientation between the toe end portion and the heel set by the rotationally-driven member. Conveniently, but not necessarily, the fingers are mounted on the carrier for movement lengthwise thereof during the operation of depositing the toe end in the clamp means.

Figure 2:
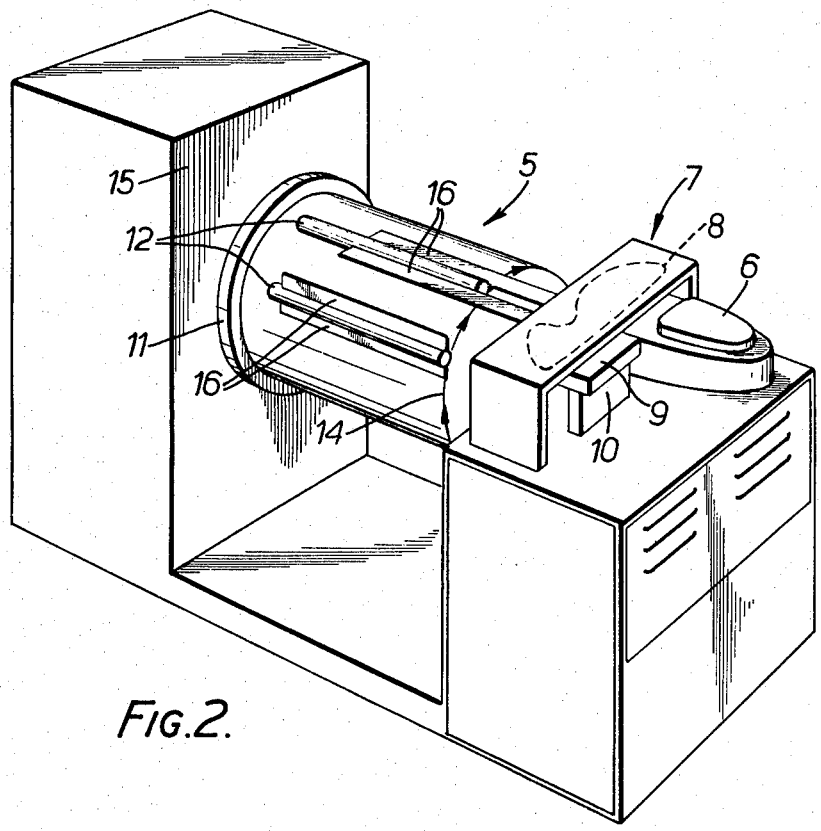
Figure 3:
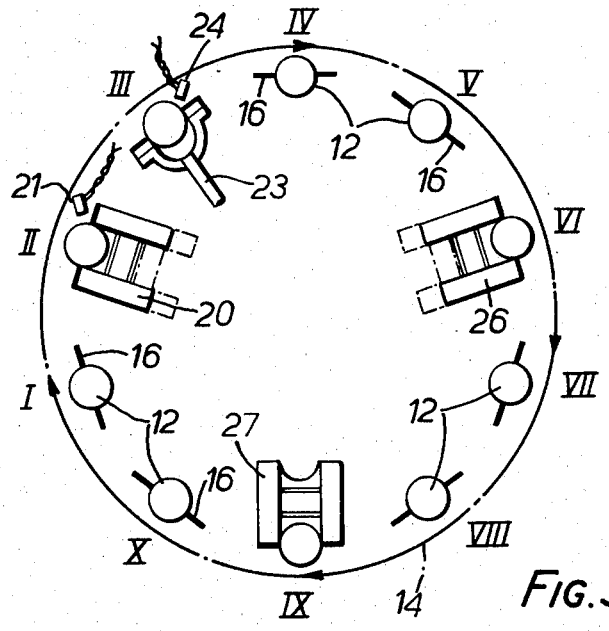
Figure 4:
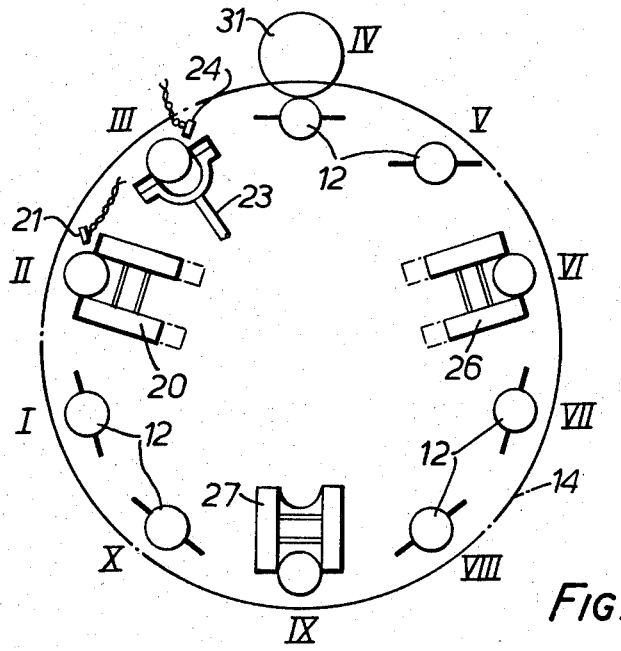
Figure 5:
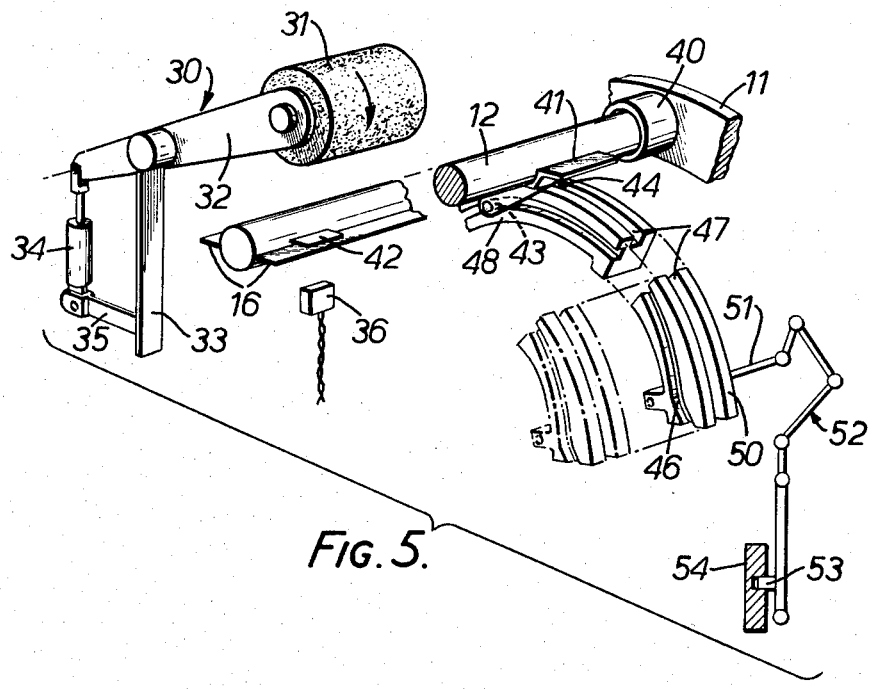
Figure 6:
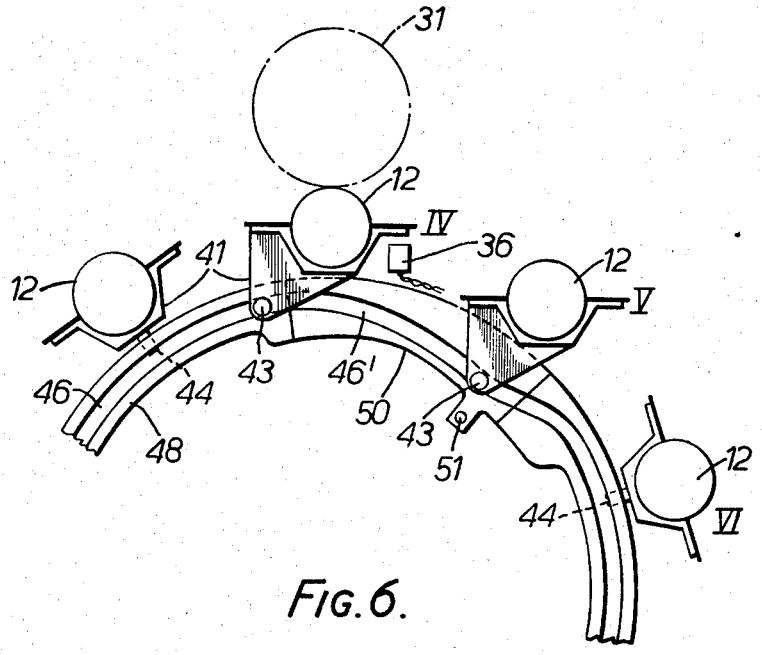
Figure 7:
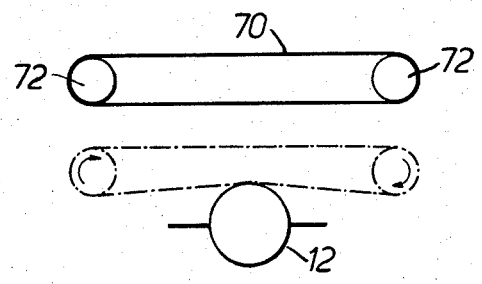
Figure 8:
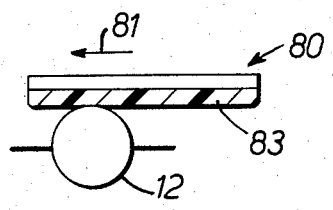

The invention will now be described in more detail by way of example with reference to the remaining Figures of the accompanying drawings, in which:

FIG. 2 is a simplified perspective view, showing the principal elements of a toe closing machine to which this invention is applicable, FIG. 3 is a schematic end elevation of a turret of a known Detexomat machine, and illustrates the work stations through which each hose to be seamed is sequentially conveyed, FIG. 4 is a view similar to FIG. 3 showing a machine according to the invention, FIG. 5 is an exploded perspective view of a machine according to the invention, illustrating equipment for attaining a predetermined heel position prior to seaming, FIG. 6 is an end elevation view showing control cam means for maintaining the predetermined position in the course of presenting hose toes to a seamer, and FIGS. 7 and 8 are schematic illustrations of modified equipment according to the invention.

The basic machine to be described for convenience is a development or modification of a known Detexomat toe closer, i.e. the "Speedomatic HS" toe closer. Special equipment (to be described) is fitted to the machine for adjusting hose blanks accurately to attain a predetermined orientation relationship between heel portion and toe seam in the finished hose. The "Speedomatic HS" machine is disclosed in our U.K. patent specification No. 1,577,758 to which reference is hereby directed.

To seam the toe ends of open-ended hose blanks, the machine 5 is fitted with a sewing and trimming machine 6 e.g. a Union Special 39500 machine. By moving a toe end along a predetermined path past the sewing machine needle, a seam of the desired shape, e.g. a fish mouth, is produced. Intermittently-operable clamp means 7 serves to grip the toe end to be seamed and then to move it past the needle. Clamp means 7 comprises an endless, intermittently-driven belt 8 and a work table 9 which extends to the sewing machine sewing head. The belt 8 is trained around pulley wheels, not shown, some of which are adjustable to determine the shape of the seam generated. The principle of operation of the clamp means 7 is described in our U.K. Pat. No. 1,501,869 to which reference is directed for details. As described in this patent, the clamp opens (to admit hose blanks for seaming and subsequently for releasing the seamed hose) and closes (to clamp toe ends and then move them past the sewing machine) by raising and lowering the belt bodily relative to a stationary work-table. In the present machine 5, the table instead is lowered and raised to open and close the clamp means 7, the table being pivotally mounted on a pillar 10.

The machine 5 is furnished with turret-mounted tubular hose carriers 12 and means for automatically advancing toe ends of hose disposed on the carriers 12 into the clamp means 7. There are ten carriers 12 on the turret 11, only two being shown for clarity in FIG. 2. Turret 11 is mounted to rotate, or index, stepwise causing each carrier 12 to sweep intermittently around a circular or cylindrical path 14. Drive means for the turret 11 are housed within a cabinet 15.

The toe end advancing means comprise reciprocally-movable fingers 16, a pair thereof being mounted on each carrier 12 in this particular machine. The fingers 16 are in the form of flat, spaced-apart blades which may spread apart in the course of transferring hose toe ends into the clamp means 7. The toe ends are presented to the clamp means 7 in a flat condition.

A cycle of operations of the "Speedomatic HS" machine will now be described with reference to FIG. 3. During one full cycle, each tubular carrier 12 moves intermittently, pausing at each of ten stations I–X.

When a carrier 12 arrives at Station I, the operator loads a hose blank thereon. Carrier 12 is in communication with a source of suction to assist eversion of the blank in known manner. The welt end of the blank is turned back over the carrier 12 and manually drawn along the carrier, this and finger blades 16 being disposed inside the blank. The turret is then indexed to cause each carrier to rotate through 36° to the next station.

Upon arrival at station II a wind-on mechanism including a rotationally driven roller 20 is actuated to engage the hose blank and draw it fully onto the carrier 12. When the toe end of the blank passes a photo-sensor 21, roller 20 is moved out of contact with the blank.

Having indexed to station III, the hose blank toe end portion is positioned longitudinally. The object is to adjust the actual toe end accurately upon the finger blades 16 such that upon transfer to the clamp means 7, it will be fed thereby past the seamer to generate a seam in the requisite location. The positioner 23 is moved into engagement with the hose blank while stationary at station III, and then shifts its toe end portion firstly away from the turret 11 and then back again. In the course of the latter movement, some discernable feature on the toe end portion approaches a photo-sensor 24, the said feature being some predetermined distance from the desired position of the seam to be generated. When the photo-sensor 24 detects the said feature, it produces a signal for disengaging the positioner 23 from the blank. The said feature can be a control mark, e.g. a coloured thread or a band of dropped stitches, the extreme end of the blank or the boundary between a reinforced toe knit and the adjacent knit of the blank. The toe end portion is in the correct longitudinal position on the blades 16, when the positioner 23 is disengaged by the sensor signal, to within 3 mm.

When the correctly-positioned hose blank arrives at station IV, its toe end portion is transferred to the clamp means 7. Transfer is achieved by the pair of finger blades 16 moving in unison relative to carrier 12, away from the turret 11 and into the open clamp means 7. The free ends of blades 16 can optionally spread apart, stretching the toe end laterally. Clamp means 7 then closes, nipping both toe end and blades 16. The latter then withdraw towards the turret 11, leaving the toe end in the clamp means. Also, after clamp means 7 has grasped the toe end, the belt 8 is set in motion to slide the toe end across work-table 9 to a position adjacent the sewing machine head.

It will be seen that at station IV, the carrier 12 is at "top dead centre" and its blades are horizontally disposed. This horizontal attitude is necessary since the work-table 9 is itself horizontal in the closed condition of the clamp.

After arrival at station V a toe closing seam is generated by the sewing machine as the toe end is moved in unison with belt 8.

Thereafter the seamed hose still on carrier 12 is conveyed to station VI, the hose arriving with its toe end portion dangling from carrier. At station VI, a driven wind-on roller 26 engages the hose length on the carrier 12 and draws the hose fully onto the carrier 12. This action tends to straighten the toe seam.

Subsequently, the hose passes through "spare" stations VII and VIII to station IX. At the latter station a reverse-driven wind-off roller 27 is engaged with the hose on carrier 12 and suction is applied through the carrier. The hose is drawn toe end first into the carrier 12 by the suction assisted by roller 27, and is then discharged from the machine. During this sucking-in action, the hose is automatically everted. After passing through "spare" station X, the unloaded carrier 12 returns to station I to be loaded with a fresh hose blank by the operator once again.

The present machine differs from the Speedomatic HS machine in one important operational respect: it is arranged to position the heel portion automatically such that the requisite, predetermined orientation relationship between heel and toe seam is always attained. Heel positioning takes place at e.g. station IV. Presentation of the toe end to the clamp means 7, and generation of the toe closing seam, are both performed at station V. Otherwise, the operating cycle—see FIG. 4—is substantially as described above in relation to the Speedomatic HS machine.

The heel positioning means 30, is shown in FIG. 5. Essentially, means 30 comprises a padded resilient roller 31 having its central axis parallel to the length of carrier 12. The roller 31 is journalled on a bracket arm 32 pivoted upon a pillar 33 which, in turn, is fixedly mounted in a manner not shown to machine cabinet 15. A double-acting pneumatic jack 34 is coupled between the arm and a bracket 35 on the pillar 33. The jack 34 is operable to swing the pivoted bracket arm 32 to and fro to engage and disengage the roller 31 with a toe end portion of a hose mounted on carrier 12. The roller is shown in its disengaged position in FIG. 5 and in its engaged position in FIGS. 4 and 6.

A drive motor, not shown, is coupled directly or indirectly to roller 31 to rotate the latter at least when engaged with the hose. The roller 31 can be continuously or discontinuously driven. When in engagement with the hose toe portion, roller 31 causes the latter to slide around the carrier (and the blades), until a signal is produced by a photo-sensor 36. The signal to disengage the roller 31 from the hose toe portion is generated by the sensor 36 when an indicating mark on the hose aligns therewith.

The indicating mark can be knitted into the hose using a contrasting thread. This mark is in a predetermined position with respect to the hose heel portion. When the photo-sensor 36 is correctly set up, the heel positioning means 30 will locate the heel accurately in such an attitude that the ultimately generated toe seam is in a prescribed orientation relationship with the heel. For example, it may be arranged that the heel is centred on a radial plane extending from the turret turning axis through the central axis of the carrier 12. After positioning, the heel may be centred atop or beneath carrier 12 as viewed in FIG. 6.

Obviously, it is essential that the adjusted position of the heel is preserved when the toe end is transferred to the clamp means 7 and fed to the sewing machine 6. No loss of adjustment is observed with the present carrier and finger blade arrangement from inadvertent rotation of the toe end portion around the carrier and blades.

In the "Speedomatic HS" machine, the blades 16 are always perpendicular to the aforementioned radial plane, this condition being observed at each of the stations I to X. At station IV where the blades 16 transfer the toe end into the clamp means, they lie in horizontal plane to suit the horizontal clamping gap between belt 8 and horizontal work-table 9.

In the present machine heel positioning is performed at station IV, and toe end transfer and seaming at station V. Again, the clamping gap and work-table 9 are horizontal. With the "Speedomatic HS" the blades 16 would lie in a plane tilted 36° from the horizontal at station V. This tilting would not suit the clamp means 7 in the present machine, which thus includes means for rotating the carrier 12 together with blades 16 about the carrier axis between stations IV and V. In the result, the blades 16 are disposed horizontally at station V, see FIGS. 5 and 6.

As shown in these drawings, each carrier 12 is mounted to rotate against spring bias, not shown, in a boss 40 fast with turret 11. The blades 16 are mounted at their turret ends on a slide 41 and are slidably received in a slit between pairs of wings 42 (one only shown) fast with the carrier 12 adjacent its free end. The slide 41 has two cam followers 43, 44 which run in two tracks 46, 47 of an annular, non-rotatably mounted cam disc 48. Track 46 is formed in the face of cam disc 48 and track 47 in its periphery. The cam disc 48 has a section 50 disposed between stations IV and V which can be moved forwardly out of the plane of the remainder of the cam disc.

Cam track 47 is coplanar with the cam disc 48 throughout the circumference of the latter. Thus, cam follower 44 will not be displaced to or fro relative to turret 11 as it runs around track 47, except as will be described hereafter.

Cam track 46 is of cardiod form. It is of constant radius except in the section 50 and in the region thereof, where its profile is designed to deflect carrier and blades about the carrier axis.

Except when travelling along track portion 46′ in section 50, cam follower 43 remains undeflected: the blades 16 stay perpendicular to the aforementioned radial plane. When each carrier is shifted from station IV upon indexing of the turret 11, cam follower 43 rides along track portion 46′ and is so deflected that the slide 41 is rotated relative to the carrier axis. Since the blades 16 are fastened to the slide 41 and by wings 42 to the rotatable carrier 12 (journalled in boss 40), the blades 16 and carrier are rotated in unison about the carrier axis. By the time carrier 12 reaches station V, rotation through 36° will have been achieved and the blades 16 will be in a common horizontal plane.

When the turret 11 next indexes, the carrier and blades move towards station VI and attitude of the latter is returned to the normal attitude perpendicular to the said radial plane as the cam follower 43 continues moving along cam track 46′, 46. This is accompanied by a return rotation of the carrier 12 in the boss 40. The return rotation is spring assisted.

When the carrier has reached station V or shortly before, the blades 16 must commence their to and fro excursion along the carrier 12 to transfer a hose toe end into the clamp means 7. This excursion is accomplished by shifting cam section 50 forward and back with respect to the remainder of cam disc 48. Movement of the cam section 50 is coupled to the blades 16 by cam track 47, cam follower 44 and slide 41. The blade excusion commences while the blades 16 are nearing the horizontal under control of cam track section 46′.

Forward and reverse movement of cam disc section 50 is produced by a push/pull rod 51 and a linkage 52 coupled through a cam follower 53 to a control cam 54. The latter is moved in timed relation with the indexing turret, and may be fast for rotation therewith. Any convenient linkage 52 will suffice, and that shown diagrammatically is merely exemplary.

For ease of servicing, reliability and economy the principal elements and operations of the machine are controlled and timed mechanically from a single drive motor which rotates the turret 11. Extensive use is made of cam actuators, for example for rotating the turret 11, moving the cam disc portion 50 to and fro, raising and lowering work-table 9 of the clamp means and moving wind-on rollers 20, 26 into and out of engagement with the hose. Supplementary motors can be used to rotate rollers 20, 26, 27 and 31, and to drive the clamp belt 8 intermittently. Operation of the positioning means 23 can be as described in our U.K. patent specification No. 1,577,758. Control valving for controlling supply of air to the operating jack 34 of the heel positioning means 30 can be conventional and conventionally actuated in response to indexing movement of the turret 11.

In the machine particularly described with reference to FIGS. 4 to 6, means necessarily had to be provided to rotate the carrier and finger blades, to match the horizontal attitude of the clamp means, because transfer is accomplished at station V.

The carrier and blade rotation means could be omitted in a modified design. This would be possible in principle if the operations performed at the various stations were displaced one position anticlockwise, as viewed in FIG. 4. Then, the operator would load at station X. Winding on would take place at station I and longitudinal positioning at station II. Heel positioning would take place at station III and transfer at station IV, scanning likewise being performed at this station if desired. Since station IV is at "top dead centre", the blades will be horizontal and hence will already be in an attitude suiting the clamp means.

It is to be understood that the invention has been described as applied to a "Speedomatic HS" machine purely for convenience. The heel positioning means can be incorporated in or installed on any automatic toe closer having one or more hose carriers around which the hose can be caused to rotate.

As identifiable features, to which the sensor of the heel positioner is responsive, contrasting threads and bands of dropped or transferred stitches have been mentioned. Instead, an inked datum mark could be applied to the hose. In some cases, exemplified particularly by patterned socks, it may be difficult for the photo-sensor to distinguish between the pattern and marks of the sort mentioned above. The mark could then be characterised by a dyestuff which contrasts clearly with the surrounding fabric when illuminated by radiation of a particular wavelength, e.g. ultra-violet light, the spectral range of the sensor of course being chosen to suit. Dyestuffs which fluoresce under ultra-violet light may be employed. The mark could be provided by a band of metal threads, the sensor then responding to the difference in reflectance between the said band and the adjacent fabric. Where metallic threads are used, a photo sensor could conceivably be replaced by circuitry which detects the completion of an electric circuit between a feeler, the threads and the carrier, the feeler being located at the set datum position.

A rotationally-driven wheel or roller is not indispensible for rotating the hose toe end portion around the carrier when heel positioning. In place of such a member, see FIG. 7, an endless driven belt 70 trained around pulleys 72 and mounted for movement into and out of contact with hose on the carrier 12 could be substituted. The operative position of the belt and pulleys is shown chain-dotted. Alternatively, use could be made of a member such as a bar 80, see FIG. 8, which, after being engaged with the carrier-mounted hose, is displaced laterally in the direction of the arrow 81 relative to the carrier 12 to cause the desired rotation of the hose. 83 is a soft pad covering the bar for protecting the hose and for frictionally gripping the hose.

The turret of the machine described above rotates stepwise from station to station. Toe closers are known, however, in which the turret carriers are always in motion. The present invention can be applied to such toe closers by mounting the heel positioning equipment on a movable support for travel in unison with each of the carriers in turn during the positioning operation.

I claim:

1. A method of automatically closing the toes of hosiery using a seamer, wherein a tubular hose blank having a predefined heel is mounted on a carrier, a toe end portion of the blank mounted on the carrier is caused to adopt a laterally spread flat condition and in this condition is moved past said seamer which generates a toe seam of a predetermined outline across the toe end portion, and wherein a driven member is brought into engagement with the toe end portion after mounting on the carrier and said toe end portion is rotated thereby around the carrier until the said toe end portion and the heel are in a predetermined attitude upon the carrier, the resulting mutual orientation of the toe end portion and heel being preserved in the course of spreading the toe end portion flat and seaming.

2. A method according to claim 1, wherein an identifiable mark is provided on said hose and said hose is rotated around the carrier until said identifiable mark reaches a predetermined datum position.

3. A method according to claim 1, wherein a rotationally-driven member is engaged frictionally with said hose for rotating said hose around the carrier.

4. A method according to claim 3, wherein an identifiable mark is provided on the hose and said hose is rotated until the mark reaches a predetermined datum position, whereupon the said member is immediately disengaged from the hose.

5. A method according to claim 1, which further includes a step of positioning a hose toe end axially of the carrier by frictionally engaging the hose on the carrier with an axially-displaceable positioning element and moving the said positioning element to and fro in the axial direction to locate an identifiable feature of the hose in a predetermined datum position.

6. A machine for automatically closing the toes of hosiery supplied in open-ended tubular form having predefined heels, the machine comprising a seamer, means for moving a flattened hose toe end past the seamer to generate a toe closing seam of predetermined outline therein, a carrier to support the hose on the machine, means movable into and out of engagement with the toe end portion of a hose on the carrier, prior to movement of the toe end past the seamer, and operative to rotate the toe end portion around the carrier and with it the heel, and control means including a sensor located at a set, datum position with respect to the carrier, the control means being operable to effect a discontinuation of rotation of the toe end portion when said sensor has detected arrival of an identifiable feature in said toe end portion in a position of alignment with the sensor.

7. A machine according to claim 6, wherein the hose rotating means comprises a rotationally-driven roller or wheel member.

8. A machine according to claim 6, wherein the hose-rotating means comprises an endless driven belt trained around pulleys and mounted for movement into and out of contact with a hose mounted on the carrier.

9. A machine according to claim 6, wherein the hose rotating means comprises a member mounted for movement into and out of contact with a house mounted on the carrier, the said member being displaceable laterally of the carrier to rotate the hose thereabout.

10. A machine for automatically closing the toes of hosiery supplied in open-ended tubular form having predefined heels, the machine comprising a seamer, movable clamp means for gripping a flattened hose toe end and for moving it past the seamer to generate a toe closing seam therein, a carrier to support the hose on the machine and means operable to advance a toe end portion of the hose from the carrier into the clamp means, the machine further including a rotationally-driven member mounted for movement into and out of engagement with the toe end portion supported on the carrier, prior to advance thereof into the clamp means, for rotating the toe end portion when engaged thereby around the carrier and with it the heel, and rotation control means including a sensor located at a set, datum position with respect to the carrier, the said control means being operable to effect a discontinuation of rotation of the toe end portion when the sensor has detected arrival of an identifiable feature in said toe end portion into a position of alignment therewith.

11. A machine according to claim 10, wherein to discontinue rotation of the toe end portion the control means is responsive to a signal generated by the sensor, upon detection of an identifiable feature of the hose, and is operative to disengage the rotationally-driven member from the hose.

12. A machine according to claim 6 which includes a plurality of hose carriers movable around a closed path through a plurality of stations whereat each carrier in turn is (1) loaded with a hose, (2) the position of the heel thereof is adjusted by rotating the toe end portion relative to the carrier, (3) the toe end portion is moved past the seamer and (4) thereafter the toe-seamed hose is unloaded from its carrier, one of the stations which each carrier encounters before arrival at the seaming station including a toe-positioner element frictionally-engageable with the hose and movable axially to and fro to set an identifiable feature of the hose to a predetermined position axially of the carrier.

* * * * *